US006638132B1

(12) United States Patent
Li

(10) Patent No.: US 6,638,132 B1
(45) Date of Patent: Oct. 28, 2003

(54) RUBBER BAND DRIVING DEVICE FOR TWO-PROPELLER MODEL PLANE

(76) Inventor: Danny H. Y. Li, Room 1002, 10/F, Singga Commercial Centre, 148-152 Connaught Road West, Hong Kong (CN)

( * ) Notice: Subject to any disclaimer, the term of this patent is extended or adjusted under 35 U.S.C. 154(b) by 0 days.

(21) Appl. No.: 10/224,948

(22) Filed: Aug. 20, 2002

(30) Foreign Application Priority Data

Jun. 26, 2002 (CN) ..... 02238236

(51) Int. Cl.[7] ..... A63H 27/02
(52) U.S. Cl. ..... 446/59; 185/39
(58) Field of Search ..... 446/57, 59, 60; 185/DIG. 1, 10, 39

(56) References Cited

U.S. PATENT DOCUMENTS 4,629,438 A * 12/1986 McAneny ..... 446/58
5,525,087 A * 6/1996 Chin-Lin ..... 446/59

* cited by examiner

*Primary Examiner*—Jacob K. Ackun
(74) *Attorney, Agent, or Firm*—Merchant & Gould, P.C.

(57) ABSTRACT

A rubber band driving device for two-propeller model plane, mainly comprising a power rubber band 1, a wooden skeletal bar 2, a rubber band winder 3, a rubber band locator 4, a power distributor 5, transmission bars 6, support bars 7, a left propeller gear box 8, a right propeller gear box 9, propeller blades 10 and 20, a propeller space locator 30, and a propelling direction adjuster 40, wherein the power rubber band 1 is connected to the rubber band winder 3 and the power distributor 5, and the power stored in the power rubber band 1 is transmitted, through the distributor 5 and the transmission bars 6, to the left and right propeller gear boxes 8 and 9, to set in motion their blades 10 and 20. The driving device disclosed in the present invention is reasonable in structure, stable in work, easy to maintain and repair, and is suitable for various kinds of two-propeller emulation model planes.

3 Claims, 6 Drawing Sheets

RUBBER BAND DRIVING DEVICE FOR TWO-PROPELLER MODEL PLANE

FIELD OF THE INVENTION

The present invention relates to a driving device for a model plane, particularly, to a rubber band driving device for a two-propeller model plane, in which the two propellers rotate in opposite directions at equal speed.

BACKGROUND OF THE INVENTION

Model planes of various kinds are being developed in many a country the world over; and development on model planes driven by rubber band has a long lead, since such models are easy and quick to assemble, safe to use, involve a low cost, and have low requirements as to the environment for use. In addition, such model planes fly gracefully; they are, therefore, widely and much used for purposes of aeronautic education and scientific popularization. They also suit outdoor games and serve as children toys as well.

In recent years, rubber band driven model planes, particularly emulation planes, have been a big hit among the public. Nevertheless, the conventional rubber band driven emulation model planes are all of the single-propeller type, since the single-propeller device results in a simple transmission mechanism, and is easy to manufacture. It is, however, noted that in the past years it was still the two-propeller model that was most welcomed by the public and became marked in the history of model planes; and people have been eager to be provided with emulation model planes of this kind. In recollection of history, an example is the "No. 1 Flyer" designed and test flown by the American Wright Brothers. That serves as a push for us to develop, as soon as possible, a rubber band driven two-propeller model plane.

SUMMARY OF THE INVENTION

Based on the above prior art, it is the object of the present invention to provide a rubber band driving device for a two-propeller emulation model plane, in which a single rubber band is used to drive two propellers to rotate at equal speed and in opposite directions, with a simple control switch and a rubber band winder suited for use with rubber bands of different powers. Another object of the present invention is to provide a rubber band driving device, reasonable in structure, simple to manufacture, and easy to maintain and repair, to be applied to various kinds of model planes. The driving device of the present invention comprises a power rubber band, a wooden skeletal bar, a rubber band winder, a rubber band locator, a power distributor, transmission bars, support bars, a left propeller gear box, a right propeller gear box, blades of the propellers, a propeller space locating bar, and a propelling direction adjuster; wherein the rubber band winder is connected to one end of the wooden skeletal bar, and on the wooden skeletal bar there are fitted a rubber band locator, a power distributor, and a propelling direction adjuster; said power rubber band being linked at one end to the rubber band winder, and to the power distributor at the other end. Two transmission bars and two support bars are connected, respectively, to the said power distributor, and further to the left and right propeller gear boxes. The propeller space locating bar is connected at both ends to the left and right propeller gear boxes, and form, together with the two support bars a triangular structure. Blades are fitted onto the left and right propellers.

In accordance with the present invention, in the preferred embodiment of the invention, there is provided a single rubber band driving device for an emulation model plane with two propellers. When a winding handle is inserted into a ratchet gearing box to wind up clockwise the said rubber band, the latter will store up power; and when a switch is pushed, by means of two drive screws, a driving torque will be transmitted from the rubber band to the gear boxes of both the right and the left propellers; and by means of different arrangement in the two gear boxes, the two propellers will rotate at equal speed but in opposite directions. As a switch is provided, unless it is pushed on, the dynamic power stored in the said rubber band will not be released.

The driving device for two-propeller model planes according to the present invention has the following advantages: 1) The emulation requirements for model planes are better met with, so that the quality of products, as well as amateurs' interest therein, are much raised and the sphere for emulation model planes is further developed. 2) As propelling direction adjusting in both longitudinal and transverse directions is possible, the propelling force can be kept stable, thus also stabling the flight of the model plane. 3) As two propellers are used which rotate in opposite directions, the gyro moment can be removed, thus also realizing stable flight. 4) As rubber bands of different kinds can be replaced, a variety of horsepower to weight ratios are available. 5) A rubber band winder and a switch adopted in the present invention make possible to store power, and flight can be easily manipulated. 6) A triangular structure formed by the propeller space locator and the two support bars, provides, together with the various connecting parts of the model plane, a robot driving device of very stable structure. 7) The driving device for a two-propeller model plane according to the present invention is easy and convenient to assemble and disassemble, and simple to maintain and repair.

The above advantages as well as others will be clearly seen in a detailed description below, in connection with the accompanying drawings.

EXPLANATION OF THE REFERENCE SIGNS IN THE ABOVE DRAWINGS

1—power rubber band; 2—wooden skeletal bar; 3—rubber band winder; 31—winder handle; 32—ratchet box; 321—left cover of ratchet box; 322—right cover of ratchet box; 323—winder head; 324—spring ring for ratchet shaft; 325—balance weight; 326—ratchet pawl; 327—driver; 328—washer; 329—bearing; 330—ratchet; 331—bearing; 332—assembling ring; 333—hexagonal gyro shaft; 4—rubber band locator; 5—power distributor; 51—switch; 52—distributor shaft; 521—washer; 522—washer; 523—ball bearing; 524—spring ring for shaft; 53—rear case of power distributor; 54—driving gear; 55—switch disc gear; 56—switch disc pivot; 57—switch disc bearing; 58—switch disc; 59—front case for power distributor; 60—limiter; 61—transmission shaft limiter; 62—end gear; 7—support bar; 8—left propeller gear box; 81—lower case of left propeller gear box; 82—bearing; 83—bevel gear; 84—bearing; 85—gyro shaft; 86—upper case of left propeller gear box; 87—assembling ring; 9—right propeller gear box; 10—blade of left propeller; 20—blade of right propeller; 30—propeller space locating bar; 40—propelling direction adjuster; 50—supporter of plane body.

DETAILED DESCRIPTION OF THE PREFERRED EMBODIMENT

Figure 1A:
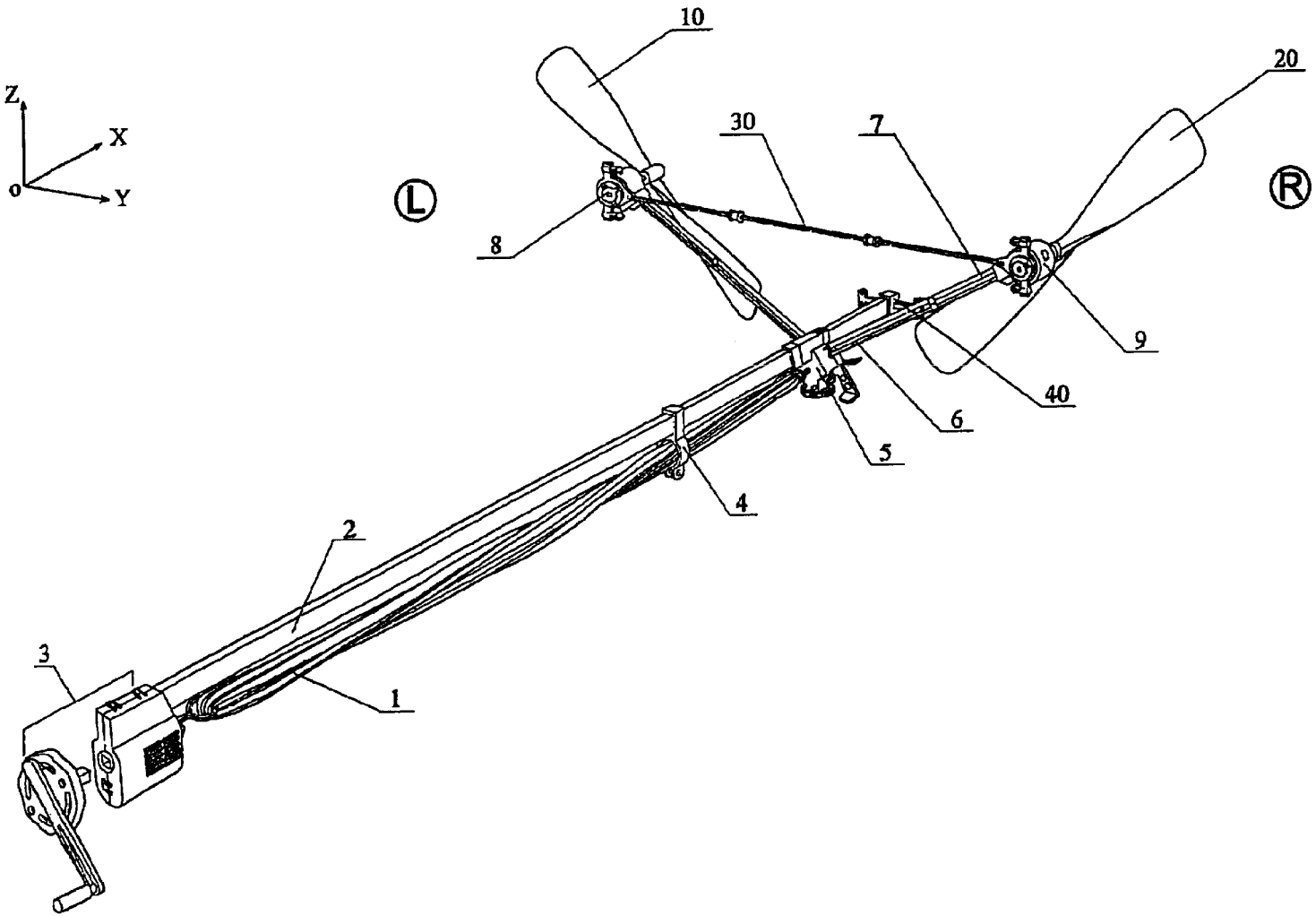
FIG. 1A is a perspective illustration showing the structure of a model plane using the driving device according to the present invention.
Figure 1B:
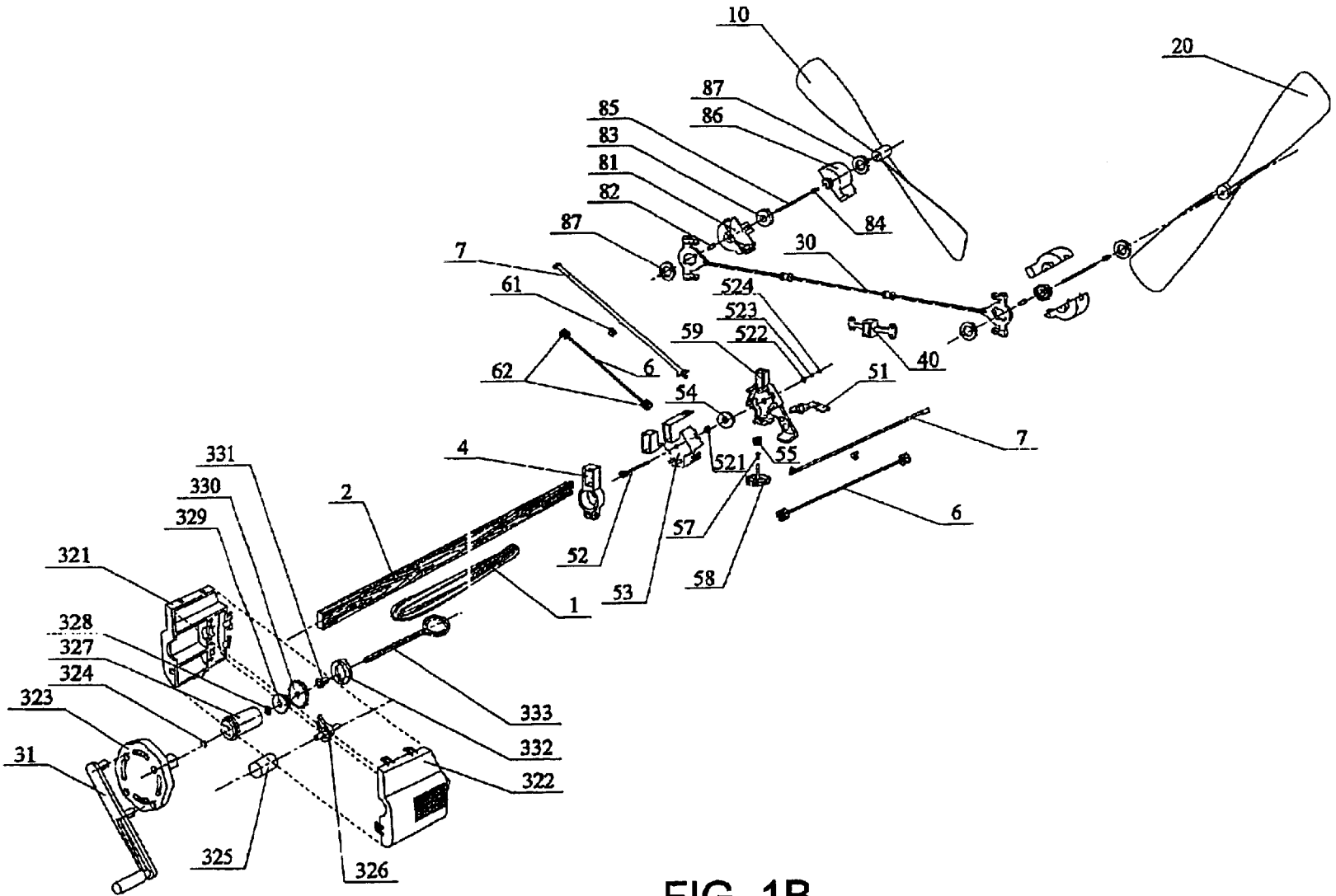
FIG. 1B is a general exploded illustration showing a model plane using the driving device according to the present invention.

As seen from FIGS. 1A and 1B, the driving device according to the present invention comprises a power rubber band 1, a wooden skeletal bar 2, a rubber band winder 3, a rubber band locator 4, a power distributor 5, transmission bars 6, support bars 7, a left propeller gear box 8, a right propeller gear box 9, left propeller blades 10, right propeller blades 20, a propeller space locating bar 30, and a propelling direction adjuster 40, wherein the said rubber band winder 3 is connected to an end of the said wooden skeletal bar 2, said wooden skeletal bar 2 being provided with a rubber band locator 4, a power distributor 5 and a propelling direction adjuster 40; said power rubber band 1 being connected at one end to the said band winder 3, while its other end is linked to the said power distributor 5; provided further are two transmission bars 6, connected respectively with the said power distributor 5, as well as the said left propeller gear box 8 and the right propeller gear box 9; two support bars 7 are provided connecting to the said power distributor 5, as well as the left propeller gear box 8 and the right propeller gear box 9, a propeller space locating bar 30 being further provided with its two ends connected to the said left propeller gear box 8 and the right propeller gear box 9, respectively, thus forming, together with the said support bars 7 a triangular structure; blades 10 being fixed onto the said left propeller gear box 8, and blades 20, onto the said right propeller gear box 9.

As can be seen from the accompanying drawings, when a winder handle 31 is inserted into the ratchet box 32, to wind the rubber band 1 clockwise, round the model plane's longitudinal axis X, the rubber band 1 is thus twisted tight to store power. When a switch 51 is raised, the power distributor 5 will transmit the torsion power of the rubber band 1, through the two transmission bars 6, to the left propeller gear box 8 and the right propeller gear box 9, thus setting the blades 10 of the left propeller and the blades 20 of the right propeller into equal speed but inverse direction rotation.

Figure 2C:
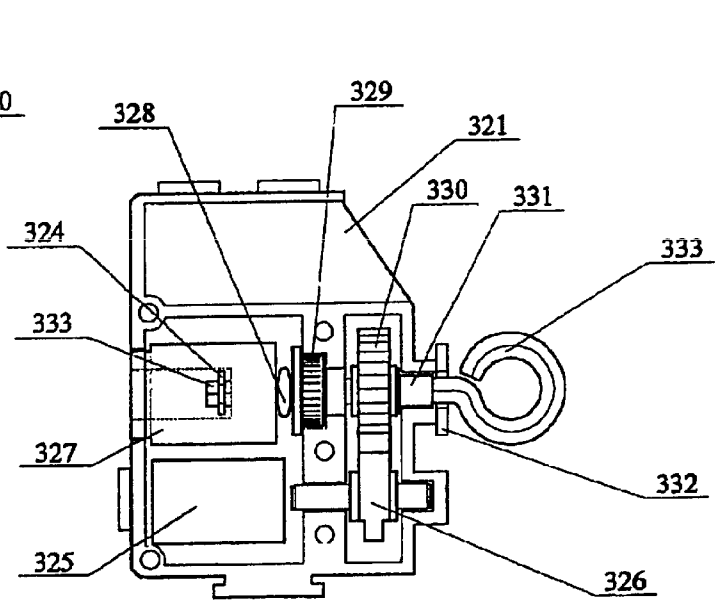
FIG. 2C is another sectional view at B—B in FIG. 2A.
Figure 2B:
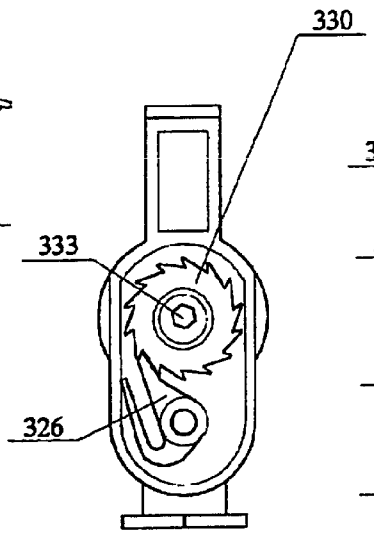
FIG. 2B is a sectional view at A—A in FIG. 2A.
Figure 2A:
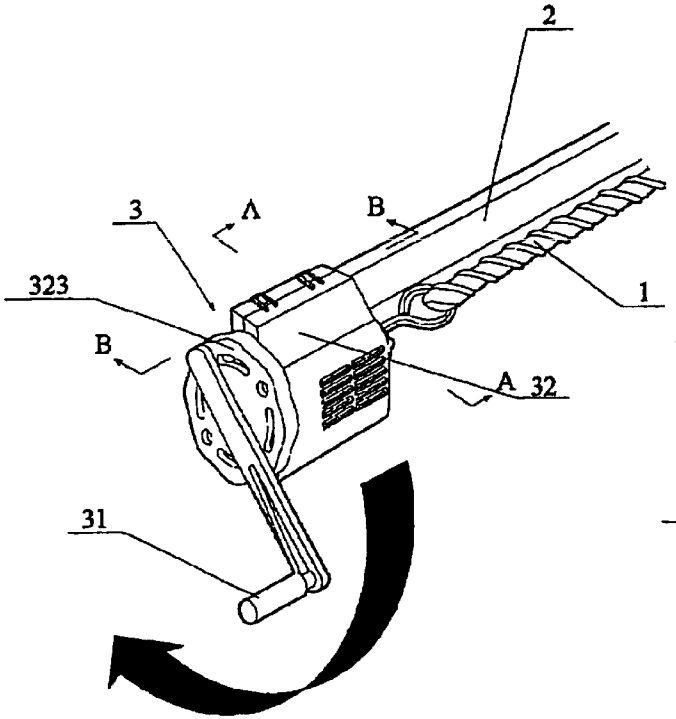
FIG. 2A is an illustration showing the rubber band winder for a model plane using the driving device according to the present invention.

Further, from FIGS. 2A, 2B, and 2C, it is shown that there is provided a ratchet box 32 which comprises a hexagonal gyro shaft 333, fixed tight to a ratchet 330 and a driver 327. When the said winder handle 31 is inserted into the winder head 323 and is turned clockwise, thus setting in synchronous rotation the driver 327, the ratchet 330, the hexagonal gyro shaft 333 and hence the power rubber band 1, the rubber band 1 is twisted and power is stored therein. Owing to the function of a ratchet pawl 326 which tends to engage with the ratchet 330, the ratchet 330 cannot reverse, and thus, nor can the rubber band 1 be released.

Figure 3A:
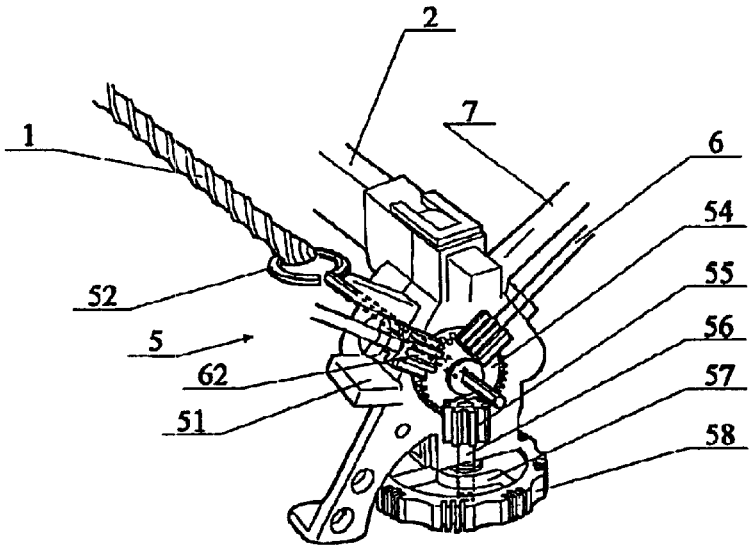
FIG. 3A is an illustration showing the power distributor for a model plane using the driving device according to the present invention.
Figure 3B:
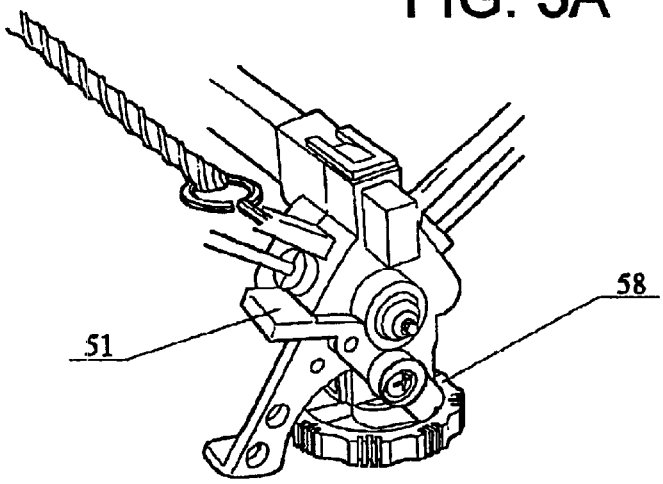
FIG. 3B is an illustration showing the said power distributor, with a switch in a raised position.
Figure 3C:
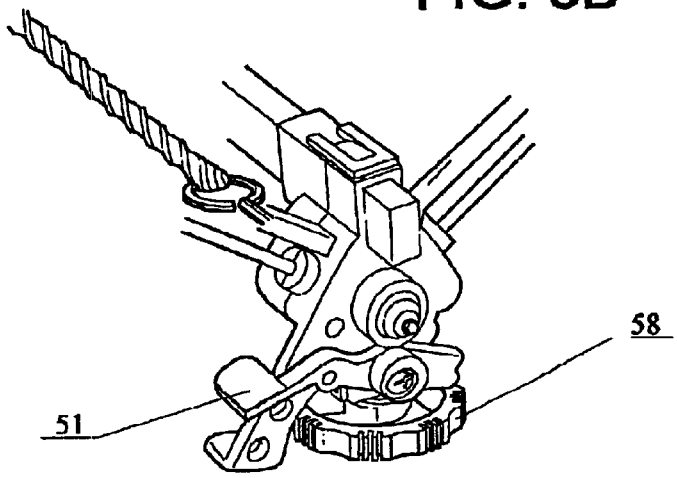
FIG. 3C is an illustration showing the said power distributor, with the said switch in a lowered position.

Now, according to FIGS. 3A, 3B, and 3C, it is seen that in the power distributor 5, a distributor shaft 52 is fixed to a driving gear 54, and the driving gear 54, in turn, is engaged with an end gear 62 at one end on the transmission bar 6, so that the torque power stored in the rubber band 1 can be transmitted through the distributor shaft 52 to the driving gear 54; in this way, the left and right transmission bars 6 will set the switch disc gear 55 into synchronous rotation. The switch disc gear 55, the switch disc pivot 56, and the switch disc 58 are fixed integrally, and are in movable fit, through the switch disc bearing 57, with the case of the said power distributor.

As is seen from the drawings, when switch 51 is raised, its head touches on the switch disc 58 so that the disc 58 cannot rotate, and neither can the driving gear 54. When the switch is lowered, however, the head of the switch 51 becomes apart from the disc 58 so that the disc 58 can rotate freely. In this way, the torque output from the rubber band 1 can be started or stopped freely.

Figures 4A, 4B:
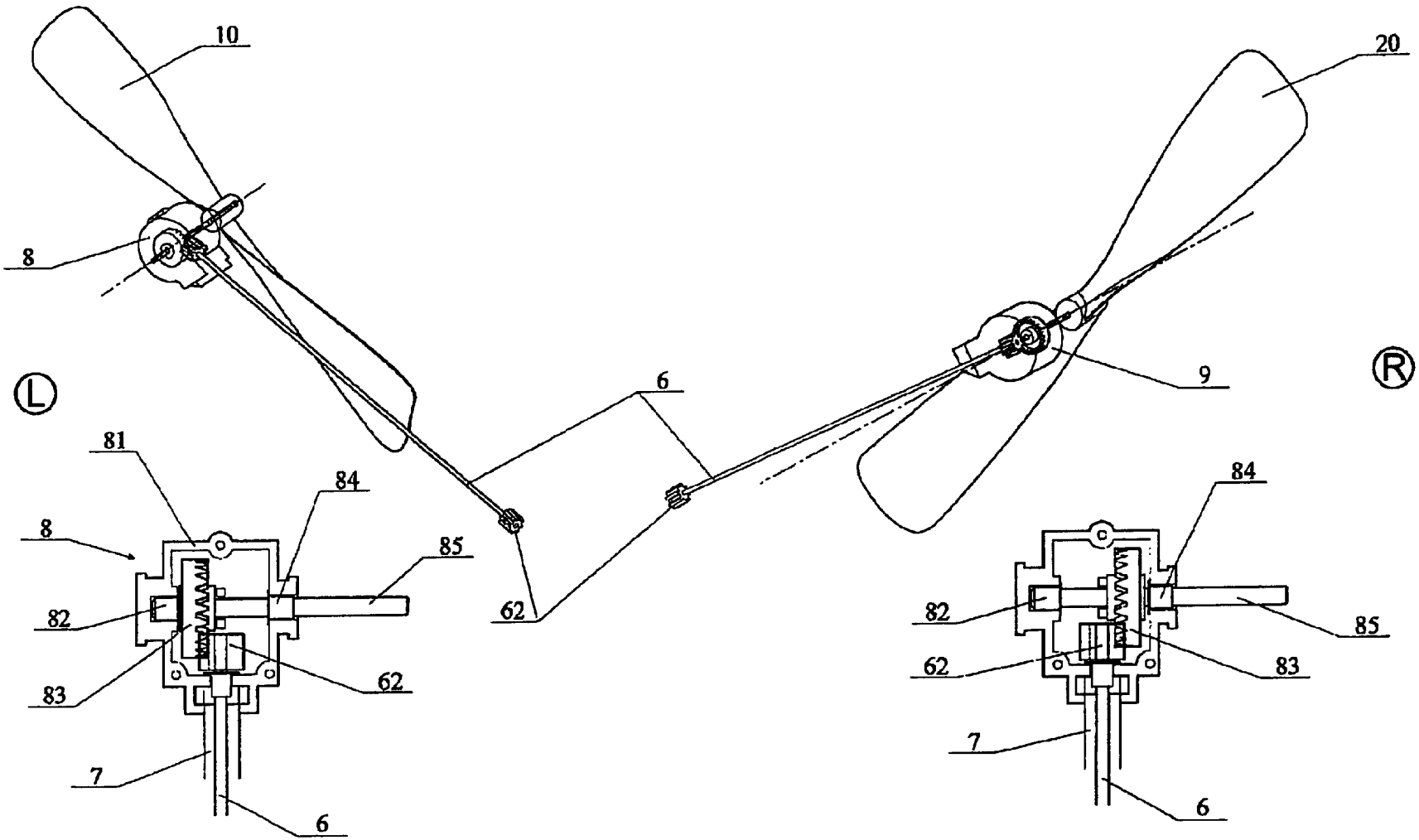
FIG. 4A is an illustration showing the structure of the gear box for the left propeller of a model plane using the driving device according to the present invention.
FIG. 4B is an illustration showing the structure of the gear box for the right propeller of a model plane using the driving device according to the present invention.

Coming to FIGS. 4A and 4B, the bevel gears 83 in the left and right propeller gear boxes 8 and 9 are seen to engage each with an end gear 62 at one end of the transmission bars. The torque from the transmission bar 6 is changed by a right angle (90°) by means of the bevel gear 83, and is further transmitted through the gyro shaft 85, which is fixed tight to the bevel gear 83, to drive the left and right propeller blades 10 and 20. In order for the left propeller blades 10 to be rotating in an opposite direction as the right propeller blades 20, the bevel gear 83 in the left propeller gear box 8 is arranged in an opposite position compared with the bevel gear 83 in the right propeller gear box 9, so that the bevel gears 83 in the left propeller gear box 8 and the right propeller gear box 9 obtain, from the synchronously rotating transmission bars 6, a torque equal in size but reverse in direction, to realize the constant speed and reverse direction rotation of the left and right propeller blades 10 and 20, while a pushing force in the same direction is created.

Figure 5A:
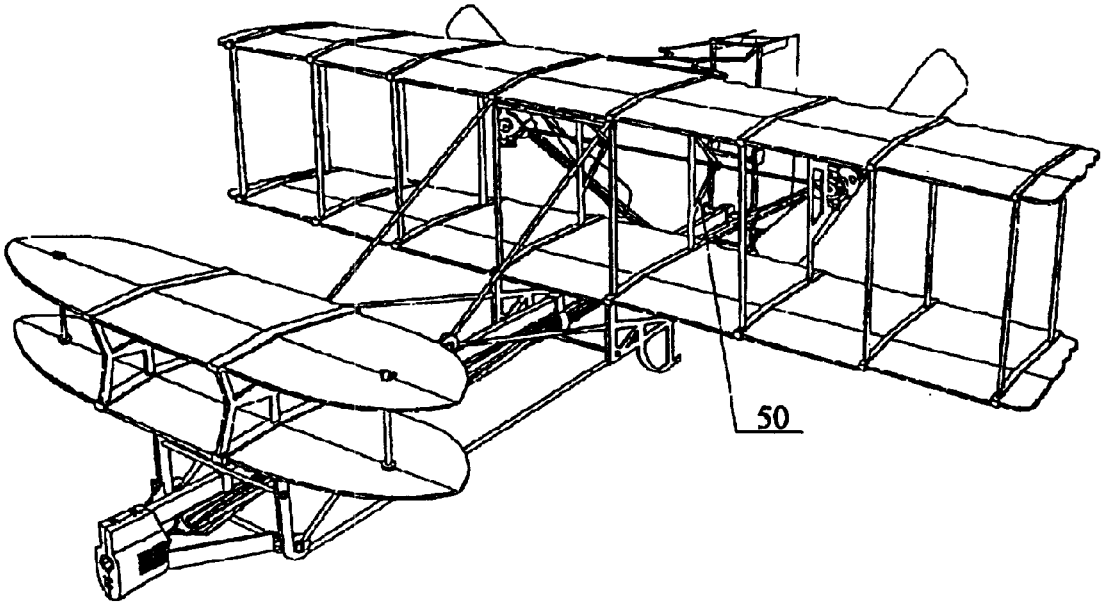
FIG. 5A is an illustration showing use of the driving device according to the present invention on an emulation model plane (the No. 1 Flyer of the Wright Brothers)
Figure 5B:
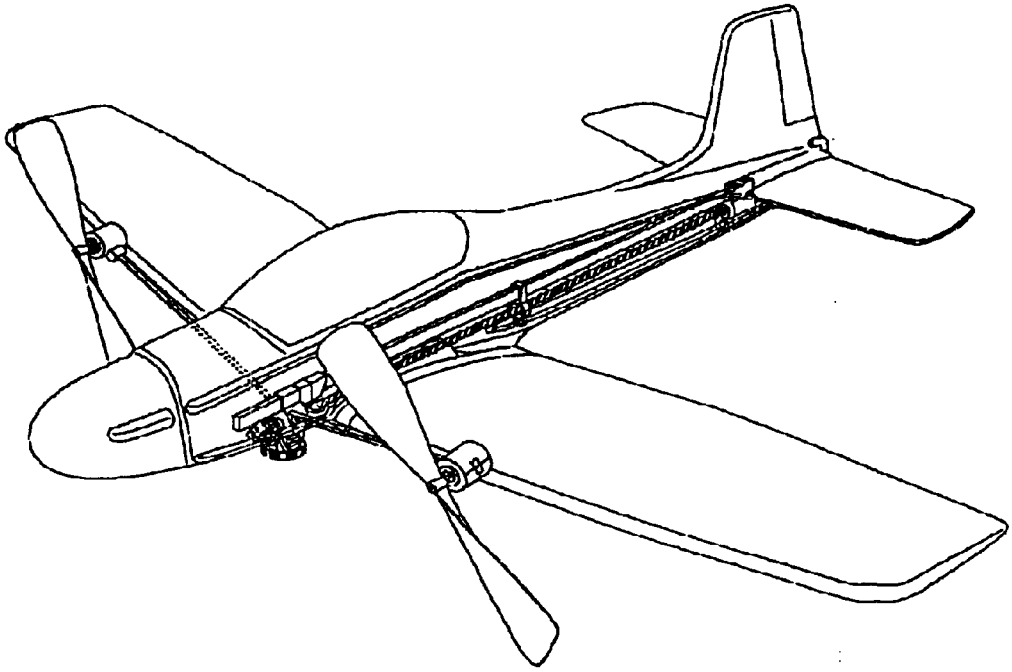
FIG. 5B shows use of the present invention on another emulation model plane.

FIG. 5A shows the driving device according to the present invention used on the No. 1 Flyer of the Wright Brothers. It is seen from that Figure that the direction of the pushing force in the power system can be adjusted through the propelling direction adjuster 40, the propeller space locating bar 30, and the plane body supporter 50. FIG. 5B shows that the driving device of the present invention can also be applied to various kinds of other two-propeller emulation model planes.

I claim:

1. A rubber band driving device for a two-propeller model plane, comprising a power rubber band, a wooden skeletal bar, a rubber band winder, a rubber band locator, a power distributor, first and second transmission bars, first and second support bars, a left propeller gear box, a right propeller gear box, and left propeller blades and right propeller blades, wherein, said wooden skeleton bar is fitted with said rubber band locator between a first end and a second end of said wooden skeleton bar, said rubber band winder being connected at said first end, said power distributor and a propelling direction adjuster being connected proximate said second end, said power rubber band having one end being connected to said rubber band winder while another end of said rubber band is linked to said power distributor:

said power distributor being connected to said first and second transmission bars and said first and second support bars, said power distributor comprises a distributor shaft fixed to a driving gear, said driving gear being engaged with a first end gear arranged at one end of each said first and second transmission bars, and rotatably engaging an integral component comprising a switch disc gear, a switch disc pivot and a switch disc, said integral component being moveably fitted through a switch disc bearing relative to said power distributor;

said right and left propeller gear boxes being respectively connected with and driving said right and left propeller blades through a second end gear fitted at an end of each said transmission bars opposite said first end gear, and respectively through a bevel gear being disposed in said right propeller gear box and a bevel gear being disposed in an opposite position in said left propeller gear box.

2. A rubber band driving device for a two-propeller model plane as claimed in claim 1, wherein said rubber band winder further comprises a ratchet box, which contains a hexagonal gyro shaft, a ratchet, and a driver, which are fixed together integrally, said ratchet box including a ratchet pawl engaging with said ratchet.

3. A rubber band driving device for a two-propeller model plane as claimed in claim 1, wherein, said switch disc including a switch, which is either raised to touch, or lowered to be apart from, said switch disc.

* * * * *